US006314711B1

(12) United States Patent
De Angelis

(10) Patent No.: US 6,314,711 B1
(45) Date of Patent: Nov. 13, 2001

(54) STRANDED SYNTHETIC FIBER ROPE

(75) Inventor: Claudio De Angelis, Luzern (CH)

(73) Assignee: Inventio AB, Hergiswil (CH)

( * ) Notice: Subject to any disclaimer, the term of this patent is extended or adjusted under 35 U.S.C. 154(b) by 0 days.

(21) Appl. No.: 09/420,355

(22) Filed: Oct. 18, 1999

(30) Foreign Application Priority Data

Oct. 23, 1998 (EP) ..... 98811067

(51) Int. Cl.[7] ..... D02G 3/02
(52) U.S. Cl. ..... 57/210; 57/213
(58) Field of Search ..... 57/210, 213, 230, 57/231, 250, 258, 232; 187/411, 412

(56) References Cited

U.S. PATENT DOCUMENTS

| | | | | |
|---|---|---|---|---|
| 1,373,632 | * | 4/1921 | Phelps | 57/213 |
| 3,106,815 | * | 10/1963 | Nance et al. | 57/210 X |
| 3,395,530 | * | 8/1968 | Campbell | 57/232 |
| 3,425,207 | * | 2/1969 | Campbell . | |
| 4,022,010 | * | 5/1977 | Gladenbeck et al. | 57/149 |
| 4,050,230 | * | 9/1977 | Senoo et al. | 57/149 |
| 4,202,164 | * | 5/1980 | Simpson | 57/232 |
| 4,270,341 | * | 6/1981 | Glushko . | |
| 4,317,000 | * | 2/1982 | Ferer | 57/230 X |
| 4,365,467 | * | 12/1982 | Pellow | 57/213 |
| 4,624,097 | * | 11/1986 | Wilcox | 57/232 |
| 4,716,989 | * | 1/1988 | Coleman et al. | 187/1 R |
| 4,827,708 | * | 5/1989 | Verreet | 57/231 X |
| 5,526,552 | | 6/1996 | De Angelis . | |
| 5,566,786 | | 10/1996 | De Angelis | 187/266 |
| 5,852,926 | * | 12/1998 | Breedlove | 57/210 |
| 5,881,843 | * | 3/1999 | O'Donnell et al. | 187/254 |
| 6,068,087 | * | 5/2000 | Moncini | 187/252 |

FOREIGN PATENT DOCUMENTS

| | | | | |
|---|---|---|---|---|
| 925181 | * | 5/1963 | (GB) | 57/231 |
| 986994 | * | 1/1983 | (SU) | 57/213 |

OTHER PUBLICATIONS

U.S. application No. 09/422,527, filed Oct. 21, 1999.
U.S. application No. 09/449,330, filed Nov. 24, 1999.
U.S. application No. 09/449,332, filed Nov. 24, 1999.
U.S. application No. 09/487,985, filed Jan. 20, 2000.
U.S. application No. 09/488,290, filed Jan. 20, 2000.
U.S. application No. 09/488,304, filed Jan. 20, 2000.

* cited by examiner

*Primary Examiner*—Rodney M. Lindsey
(74) *Attorney, Agent, or Firm*—MacMillan, Sobanski & Todd, LLC

(57) ABSTRACT

A rope has a rope core formed of load-bearing aramide fiber strands laid parallel to each other in concentric layers of strands and strands of an outermost layer laid with opposite lay to the rope core. As a result of the opposite lay, the torques which occur in the layers of strands when under load cancel each other out and a non-twisting rope structure is achieved. An elastic intersheath is positioned between the oppositely laid layers of strands to protect the strands against abrasion and to transmit the torque over a wide area in the rope.

15 Claims, 3 Drawing Sheets

STRANDED SYNTHETIC FIBER ROPE

BACKGROUND OF THE INVENTION

The present invention relates to a synthetic fiber rope, preferably of aromatic polyamide.

Especially in materials handling technology, for example on elevators, in crane construction, and in mining, ropes are an important element of machinery and subject to heavy use. An especially complex aspect is the loading of driven or over pulleys deflected ropes, for example, as they are used in elevator construction.

In conventional elevator installations the car sling of a car, which is moved in an elevator hoistway, and a counterweight are connected together by a steel rope. To raise and lower the car and the counterweight, the rope runs over a traction sheave that is driven by a drive motor. The drive torque is transferred by friction to the section of the rope which at any moment is lying in the angle of wrap. At this point the rope is subjected to high transverse forces. As the loaded rope is reversed by passing over the traction sheave, the strands move relative to each other to compensate for differences in tensile stress. The same refers to ropes wound on drums as they are used in elevators or cranes.

On elevator installations the lengths of rope needed are large, and considerations of energy lead to the demand for smallest possible masses. High-tensile synthetic fiber ropes, for example of aromatic polyamides or aramides with highly oriented molecule chains, fulfil these requirements better than steel ropes.

By comparison with conventional steel ropes of the same cross sectional area, ropes constructed of aramide fibers have a substantially higher lifting capacity and only between one fifth and one sixth of the specific gravity. In contrast to steel, however, the atomic structure of aramide fiber causes it to have a low ultimate elongation and a low shear strength.

Consequently, so that the aramide fibers are subjected to the smallest possible transverse stresses as they pass over the traction sheave, there is proposed in European patent document EP 0 672 781 A1, for example, an aramide fiber rope suitable for use as a traction rope. Between the outermost and inner layers of strands there is an intersheath which prevents contact between the strands of different layers and thereby reduces the wear due to their rubbing against each other. The previously known aramide rope described so far has satisfactory values of service life, resistance to abrasion, and fatigue strength under reversed bending stresses; however, it has been established that due to the parallel lay there is a possibility that in the permanently loaded traction rope, an inner torque acts over a section of rope beginning at the traction sheave, and as it passes over the traction sheave the section twists or untwists about its longitudinal axis. As a consequence of the resulting stress, changes in the structure can occur, which then lead to excessive length of individual outermost strands. The excessive lengths are transported within the rope in repeated passages of the rope over the traction sheave. Such a change in the structure of the rope is undesirable because it could lead to a reduction in the breaking load of the rope or even to failure of the rope.

SUMMARY OF THE INVENTION

An objective of the present invention is to avoid the disadvantages of the known synthetic fiber rope and to propose a synthetic fiber rope with a non-twisting structure.

The advantages resulting from the present invention relate to the fact that torques which arise under load due to the construction of the rope are by means of the opposite lay of the strands of the outer layer to the inner strands that carry them mutually canceled out resulting externally in a non-twisting rope construction. In principle, the advantages are obtained by any rope according to the invention which is under tensile loading irrespective of whether the rope in question is used in a moving or stationary manner.

It is advantageous to construct the inner layer of strands from strands with different diameters. An arrangement which alternates large-diameter strands and small-diameter strands results in a layer of strands with an almost circular cross section and a high fill factor. Overall, the strands then lie close together and support each other, resulting in a very compact and firm lay which deforms little on the traction sheave and demonstrates no tendency to unwind.

Furthermore, due to strands of different layers lying on top of and parallel to each other, contact occurs along their length which results in a much lower level of surface pressure perpendicular to the strands. This applies in the same way to aramide fibers of a strand. If the synthetic fibers of a strand are laid in the same direction of lay as the strands themselves, improved cohesion of the lay is obtained.

Moreover, the service life of parallel laid strands can be increased if, for example, in a parallel lay rope with two layers, the direction of twist of the fibers of strands of one layer of strands is opposite to the direction of twist of the fibers of strands of the other layer.

An advantageous distribution over the entire cross section of the strands of the forces acting on a synthetic fiber rope used as a traction rope is achieved in a preferred embodiment of the invention by means of the strands on the outside and the strands of the inner layer of strands being laid with a ratio between their lengths of lay of between 1:5 and 1:8. When the rope is loaded this results in a homogeneous distribution of stress over all the high tensile strands. This means that all the strands contribute to the tensile strength of the rope, thereby giving a high fatigue strength under reversed bending stresses and a long service life for the rope overall.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF TIE PREFERRED EMBODIMENT

Figure 1:
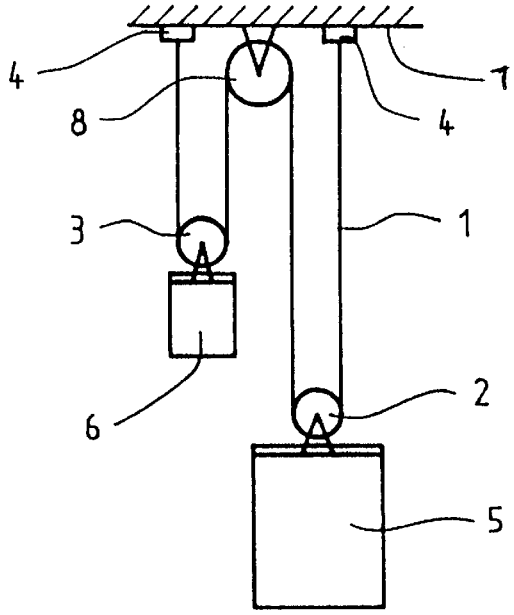
FIG. 1 is a schematic representation of an elevator installation with 2:1 roping.
Figure 2:
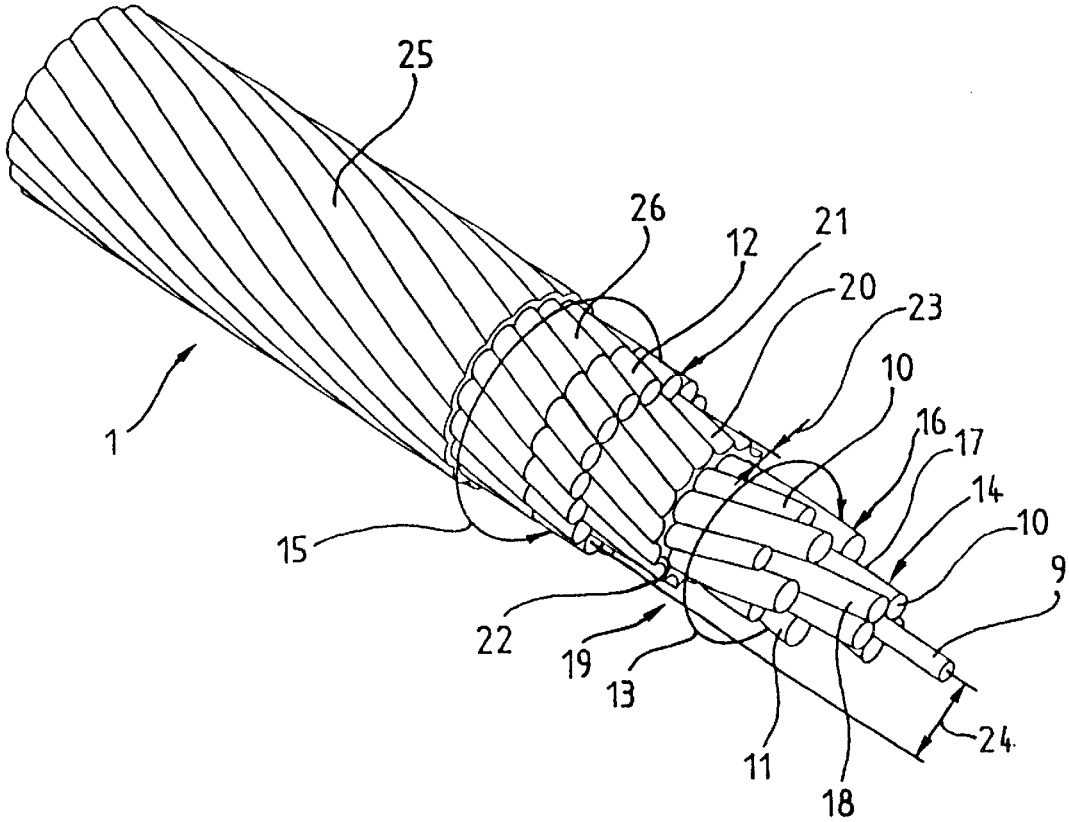

FIG. 1 shows a schematic representation of an elevator installation with a 2:1 roping arrangement over two return pulleys 2 and 3. With this arrangement, rope end connectors 4 for a traction rope 1 are not fastened to a car 5 and a counterweight 6 but in each case to the top end of a hoistway 7. The reversal at the two return pulleys 2 and 3 and at a traction sheave 8 of the traction rope 1 which is loaded with the car 5 and counterweight 6 can be clearly seen. FIG. 2 shows a first embodiment of the traction rope 1 according to the invention. Strands 9, 10, 11 and 12 for use in the elevator rope 1 are twisted or laid from individual aramide fibers. To protect the fibers, each individual aramide fiber, as well as the strands 9, 10, 11 and 12 themselves, is treated with an impregnating substance, e.g. polyurethane solution. Depending on the reverse bending performance required, the proportion of polyurethane can be between ten and sixty percent.

The traction rope 1 is constructed of the core strand 9 around which in a first direction of lay 13 five identical strands 10 are laid helically in a first layer of strands 14, and with them ten strands 10 and 11 of a second layer of strands 16 in parallel lay in a balanced ratio between the direction of twist and the direction of lay of the fibers and strands. The aramide fibers can be laid in the same or the opposite direction of lay as the strands of the layer of strands to which they belong. With the same direction of lay a better cohesion of the stranding in the unloaded condition is achieved. The service life can be lengthened if the direction of twist of the fibers of the first layer of strands 14 is opposite to the direction of twist of the fibers of the strands 10 and 11 of the second layer of strands 16, or vice versa.

The second layer of strands 16 comprises an alternating arrangement of two types of five identical strands 10 and 11 each. Five strands 11 with large diameter lie helically in hollows 18 of the first layer of strands 14 which supports them, while five strands 10 with the diameter of the strands 10 of the first layer of strands 14 lie on the highest points 17 of the first layer of strands 14 that supports them and thereby fill the gaps 18 between two adjacent strands 11 having a greater diameter. In this way the doubly parallel laid rope core 19 receives the second layer of strands 16 with an almost cylindrical external profile which in combination with an intersheath 20 affords further advantages which are subsequently described below.

When the traction rope 1 is loaded longitudinally, the parallel lay of the rope core 19 creates a torque in the opposite direction to the direction of lay 13.

With the rope core 19, about seventeen strands 12 are laid in hawser manner in a second direction of lay 15 opposite to the first direction of lay 13 to form a covering layer of strands 21. In the illustrated embodiment, the ratio of the length of lay of the strands 12 lying on the outside layer 21 to the strands 10 and 11 of the inner layers of strands 14 and 16 is 1:6. Generally speaking, a ratio of length of lay in the range 1:5 to 1:8 is advantageous for the opposite lay. This results in an essentially identical helix angle of the helically lying strands 10 and 11 of the inner two layers of strands 14 and 16 and the strands 12 of the covering layer of strands 21 with an allowable deviation in a range of +/− two angular degrees. Under load, the lay of the covering layer of strands 21 develops a torque in the opposite direction to the second direction of lay 15.

Between the covering layer of strands 21 laid in the second direction of lay 15 and the strands 10 and 11 of the second layer of strands 16 is an intersheath 20. The intersheath takes the form of a tube enveloping the second layer of strands 16 and prevents contact of the strands 10 and 11 with the strands 12. In this way it prevents wear of the strands 10, 11 and 12 being caused by the strands 10, 11 and 12 rubbing against each other when relative movement occurs between them when the traction rope 1 runs over the traction sheave 8.

A further function of the intersheath 20 is transmission of the torque, which is developed in the covering layer of strands 21 when the traction rope 1 is under load, to the second layer of strands 16, and thereby to the rope core 19, whose parallel lay in the first direction of lay 13 develops a torque in the opposite direction to the direction of lay when the rope is longitudinally loaded. Moreover, the intersheath 20, which is of an elastically deformable material such as polyurethane or polyester elastomers, is molded or extruded onto the rope core 19. Under the centrally acting constricting force of the covering layer of strands 21, the intersheath 20 becomes elastically deformed, lying close against the contours of the circumferential sheath of the layers of strands 16 and 21 acting on it, and filling all the interstices 22.

Its elasticity must be greater than that of the strand impregnation and that of the supporting strand material so as to prevent their becoming prematurely damaged. On the other hand, the overall extension of the intersheath 20 should in all cases be greater than the maximum movement that occurs of the strands 10, 11 and 12 relative to each other. At the same time, the coefficient of friction $\mu>0.15$ between the strands 10, 11 and 12 and the intersheath 20 is so chosen that practically no relative movement occurs between the strands and the intersheath 20, but so that the intersheath 20 follows the compensating movements by deforming elastically.

The thickness 23 of the intersheath 20 can be used to set in a controlled manner the radial distance 24 of the covering layer of strands 21 from the center of rotation of the traction rope 1 and thereby neutralize the torque ratio between the torque of the covering layer of strands 21 and of the parallel laid rope core 19 which act in opposite directions in the loaded traction rope 1. The thickness 23 selected for the intersheath 20 must be increased with increasing diameter of the strands 12 and/or the strands 9 and 10. In all cases, the thickness 23 of the intersheath 20 must be given such a dimension as to ensure that under load, when the flowing process is complete and the interstices between the strands 12 are completely filled, there is a remaining sheath thickness of 0.1 mm between strands 10, 11, and 12 of the adjacent layers of strands 16 and 21. The elastically deformed intersheath 20 causes a homogenized transmission of torque over the entire circumferential sheath surface of the second layer of strands 16. As a result, the constricting force of the covering layer of strands 21 and the torque of the covering layer of strands 16 no longer acts mainly on the highest points 17 of individual strands but is spread widely over the entire surface of the circumferential sheath. High concentrations of force are avoided and instead there are surface forces of a smaller magnitude which act on the surface. The volume of the interstices 22 between the strands can be minimized by an alternating arrangement of strands of large diameter 11 and strands of smaller diameter 10 in the second layer of strands 16.

In a further variant of the embodiment, the second layer of strands 16 is not enclosed in an intersheath as one entity, but the strands 10, 11 and/or 12 are each surrounded by a sheath of synthetic material with appropriate elastic properties. In this connection, care should be taken that the coefficient of friction of the sheathing material is as high as possible.

A rope sheath 25 is provided as a protective sheath for the aramide fiber strands. The rope sheath 25 consists of synthetic material, preferably polyurethane, and ensures that the coefficient of friction on the traction sheave 8 is of the required value $\mu$. Furthermore, the abrasion resistance of the sheath of synthetic material is also a rigorous requirement so that no damage occurs as the elevator rope runs over the traction sheave 8. The rope sheath 25 bonds so well with the covering layer of strands 21 that as the traction rope 1 runs over the traction sheave 8 with the transverse and pressure forces which arise between them no relative movement occurs.

Apart from a rope sheath 25 which encloses the entire covering layer of strands 21, each individual strand 12 can in addition be provided with a separate, seamless sheath 26. The remaining structure of the traction rope 1 remains unchanged, however.

Figure 3:
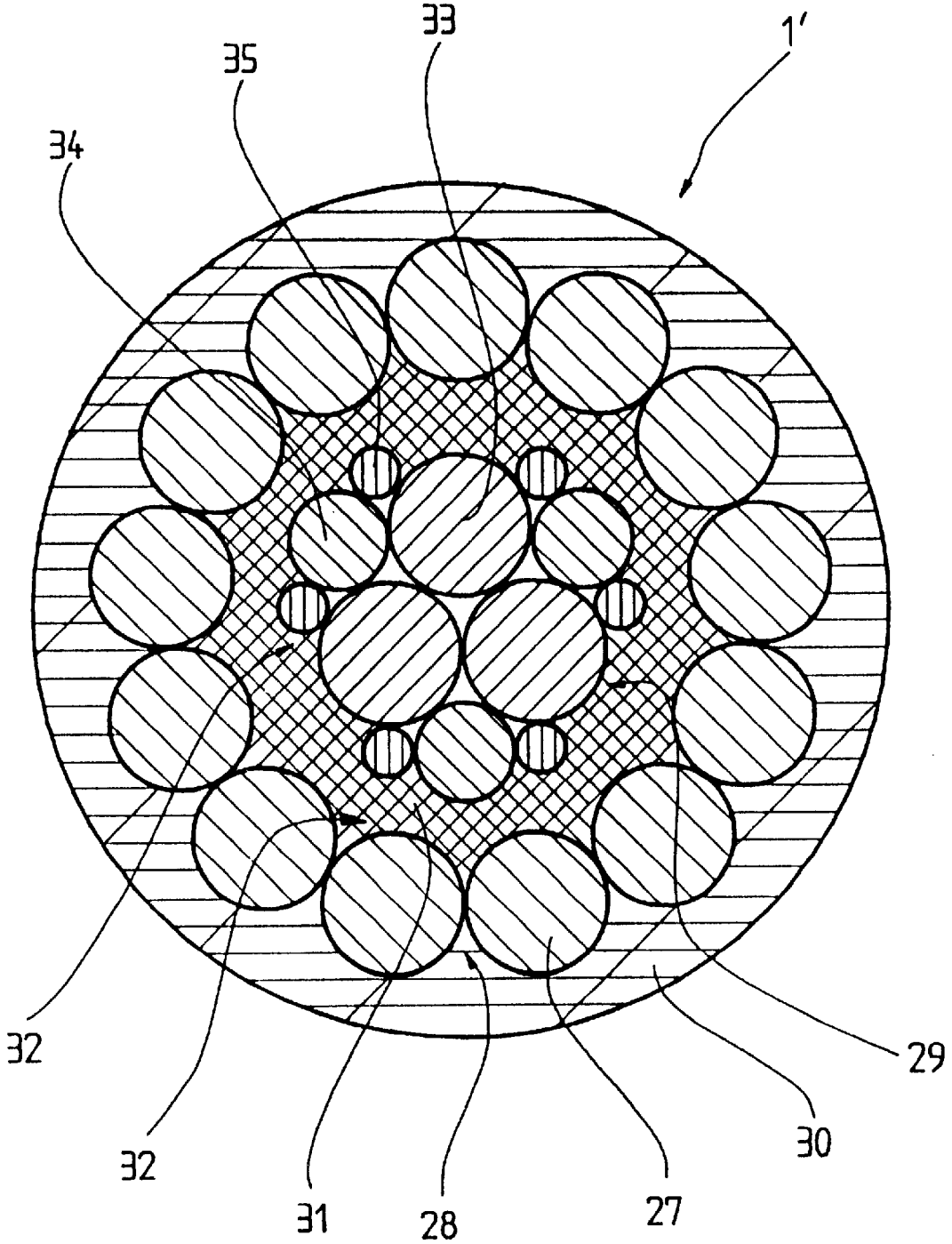
FIG. 3 is a cross-sectional view of a second embodiment of an opposite lay rope according to the present invention.

FIG. 3 shows a view of a cross section of the structure of a second embodiment of a rope 1' with opposite lay according to the invention in the unloaded state. In this second embodiment strands 27 are also laid to form a covering layer of strands 28 with opposite lay to a rope core 29. The covering layer of strands 28 comprises thirteen strands 27 and is covered by a rope sheath 30. An intersheath 31 is positioned between the covering layer of strands 28 and the rope core 29. The intersheath 31 lies against the surfaces of the adjacent sheaths of the covering layer of strands 28 and the rope core 29 and completely fills the interstices 32 between the strands 27 of the covering layer 28 and the strands of the rope core 29. As regards material, dimensions, and function of the intersheath 31, what is stated above in relation to the intersheath 20 of the first embodiment applies. The rope core 29 is constructed of three different thicknesses of strands 33, 34 and 35 made from aramide fibers, three strands 33 forming a rope core, around which strands 34 and strands 35 are laid in alternating sequence with parallel lay.

Figure 4:
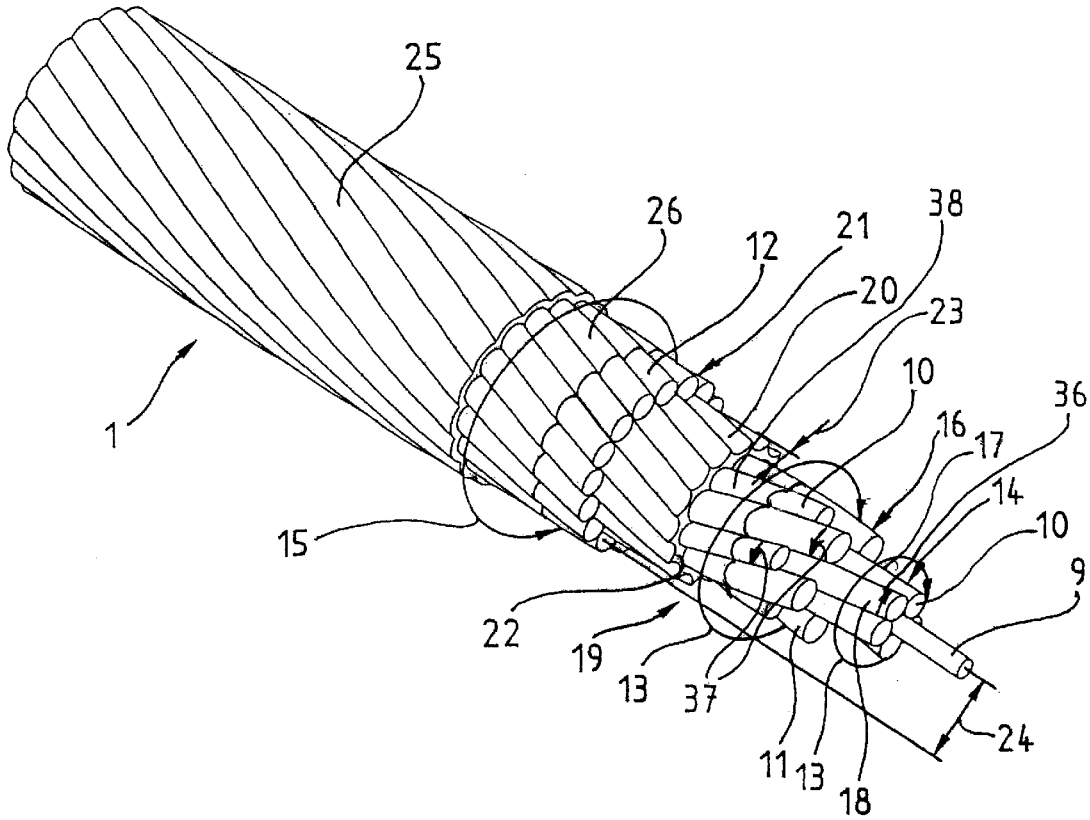
FIG. 4 is a perspective representation of a third embodiment of an opposite lay rope according to the present invention.

FIG. 4 is similar to FIG. 2 and shows a third variant of the embodiment wherein the second layer of stands 16 is not enclosed in an intersheath as one entity, but the strands 10 and 11 are each surrounded by a sheath 38 of synthetic material with appropriate elastic properties. In this connection, care should be taken that the coefficient of friction of the sheathing material is as high as possible. Also, the fibers of the strands 10 of the first inner layer 14 are laid in a direction of twist 36 that is the same as the direction of twist 13 while the fibers of the strands 10 and 11 of the second inner layer 16 are laid in a direction of twist 37 opposite to the direction twist 36.

In addition to the embodiments described above, one or more layers of covering strands each having a lay opposite to that of the layer of strands which supports it can be laid coaxial with each other. Moreover, multiply laid covering layers of strands can also be created. With respect to the advantageous effect achieved by the invention, care must be taken that the torques emanating from the layers of strands are always mutually compensated.

Beside in elevators and aerial cableways, the rope according the present invention is applicable in various installations for material handling, for example for elevators, hoisting, cranes for house construction, factories or ships, ski lifts or for escalators. The rope can be driven by a traction device; either by a traction sheave or by a turning drum on which the rope is coiled up. In all such uses, the rope is led over an arcuate traction surface of the traction device.

As well as being used purely as a suspension rope, the rope can be used in a wide range of equipment for handling materials, examples being elevators, hoisting gear in mines, building cranes, indoor cranes, ship's cranes, aerial cableways, and ski lifts, as well as a means of traction on escalators. The drive can be applied by friction on traction sheaves or Koepe sheaves, or by the rope being wound on rotating rope drums. A hauling rope is to be understood as a moving, driven rope, which is sometimes also referred to as a traction or suspension rope.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A synthetic fiber rope having a plurality of load bearing strands comprising:

a plurality of load bearing strands of multiple synthetic fibers laid together to form at least two concentric layers of said strands including an outer layer and an adjacent inner layer, said strands of said inner layer being laid in a first direction of lay opposite to a second direction of lay of said strands of said outer layer; and an elastically deformable intermediate layer positioned between said inner layer and said outer layer of said strands whereby when a torque is applied to said outer layer, said intermediate layer fills all interstices between said strands of said inner layer and said outer layer thereby preventing relative movement between said strands and said intermediate layer and causing a homogenized transmission of the torque applied to said outer layer over substantially an entire abutting surface of said inner layer.

2. The synthetic fiber rope according to claim 1 wherein said strands of said inner layer are of at least two different diameters.

3. The synthetic fiber rope according to claim 1 wherein said strands are formed of aramide fibers lying parallel to each other.

4. The synthetic fiber rope according to claim 1 wherein said synthetic fibers in each of said layers are laid in a direction of lay of said strands of said layer in which said synthetic fibers are located.

5. The synthetic fiber rope according to claim 1 wherein said strands of said inner layer are laid with a lay parallel to a lay of an adjacent layer of said strands to form a rope core, a direction of twist of said synthetic fibers of said strands of said adjacent layer being opposite to a direction of twist of said synthetic fibers of said strands of said inner layer.

6. The synthetic fiber rope according to claim 1 wherein said outer layer and said strands of said inner layer are laid so that lengths of said lays have a ratio of between 1:5 and 1:8.

7. The synthetic fiber rope according to claim 1 wherein said intermediate layer is formed as a tubular intersheath which surrounds said inner layer of said strands.

8. The synthetic fiber rope according to claim 1 wherein each of said strands of said inner layer is enclosed by a sheath.

9. The synthetic fiber rope according to claim 1 wherein each of said strands of said outer layer is enclosed by a separate sheath.

10. The synthetic fiber rope according to claim 9 wherein each of said strands of said inner layer is enclosed by a sheath.

11. An elevator installation comprising:

an elevator car;

a traction sheave; and a synthetic fiber rope in friction contact with said traction sheave and supporting said elevator car, said rope having a plurality of load bearing strands of synthetic fibers laid together to form at least two concentric layers of said strands including an outer layer and an adjacent inner layer, said strands of said inner layer being laid in a first direction of lay opposite to a second direction of lay of said strands of said outer layer; and an elastically deformable intermediate layer positioned between said inner layer and said outer layer of said strands whereby when a torque is applied to said outer layer, said intermediate layer fills all interstices between said strands of said inner layer and said outer layer thereby preventing relative movement between said intermediate layer and said strands and causing a homogenized transmission of the torque applied to said outer layer over substantially an entire abutting surface of said inner layer.

12. A synthetic fiber rope having a plurality of load bearing strands comprising:

a plurality of load bearing strands of synthetic fibers laid together to form at least two concentric layers of said strands including an outer layer and an adjacent inner layer, said strands of said inner layer being laid in a first direction of lay opposite to a second direction of lay of said strands of said outer layer, said outer layer being surrounded by a sheath filling intermediate spaces between said stands of said outer layer at an outer circumference of the rope; and an elastically deformable intermediate layer positioned between said inner layer and said outer layer of said strands whereby when a torque is applied to said outer layer, said intermediate layer fills all interstices between said strands of said inner layer and said outer layer thereby preventing relative movement between said intermediate layer and said strands and causing a homogenized transmission of the torque applied to said outer layer over substantially an entire abutting surface of said inner layer.

13. The synthetic fiber rope according to claim 12 wherein said load bearing strands of synthetic fiber are laid helically together.

14. The synthetic fiber rope according to claim 12 wherein said load bearing strands are laid together around a core strand.

15. The synthetic fiber rope according to claim 12 wherein said load bearing strands are laid helically together around a core strand to form a plurality of concentric inner strand layers laid in said first direction of lay including said inner layer, said strands of said outer layer being laid in said second direction of lay opposite to said first direction of lay of said strands of said inner layers.

* * * * *